US006449456B1

(12) United States Patent
Cahill et al.

(10) Patent No.: US 6,449,456 B1
(45) Date of Patent: Sep. 10, 2002

(54) METHOD AND SYSTEM FOR PROVIDING MORE UNIFORM FUSER OIL DISTRIBUTION ON A FUSER SURFACE

(75) Inventors: David F. Cahill, Rochester; Clifton T. Hartford, Caledonia, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/686,030

(22) Filed: Oct. 11, 2000

(51) Int. Cl.[7] ..... G03G 15/20
(52) U.S. Cl. ..... 399/325; 118/60
(58) Field of Search ..... 399/324–326; 118/60; 432/60

(56) References Cited

U.S. PATENT DOCUMENTS 4,045,165 A * 8/1977 Nakajima et al. ..... 432/60
4,285,295 A * 8/1981 Iwao et al. ..... 118/60
4,501,483 A 2/1985 Romansky et al.
5,477,316 A 12/1995 Morganti et al.
5,708,914 A 1/1998 Mills et al.
5,781,840 A 7/1998 Chen et al.
5,805,968 A 9/1998 Chatterjee et al.
5,824,416 A 10/1998 Chen et al.
5,871,878 A 2/1999 Chatterjee et al.
6,091,924 A * 7/2000 Bhattacharya ..... 399/325

OTHER PUBLICATIONS

"Waldes Truarc Retaining Rings and Assembly Tools (Technical Manual) Design Data and Engineering Specifications" Waldes Kohinoor, Inc. 47–16 Austel Place, P.O. Box 1030, Long Island City, N.Y. 11101.

* cited by examiner

*Primary Examiner*—William J. Royer

(57) ABSTRACT

A method and a system for providing more uniform fuser oil distribution on a fuser surface by positioning a fuser oil redistribution roller in interactive contact with the fuser surface to absorb and redistribute fuser oil from areas of high oil concentration on the fuser surface.

20 Claims, 4 Drawing Sheets

METHOD AND SYSTEM FOR PROVIDING MORE UNIFORM FUSER OIL DISTRIBUTION ON A FUSER SURFACE

FIELD OF THE INVENTION

This invention relates to a method and a system for redistributing fuser oil from areas of high fuser oil concentration on a fuser surface to provide more uniform fuser oil distribution on the fuser surface.

BACKGROUND OF THE INVENTION

Electrophotographic copier/duplicator machines typically use dry toner to create an image on paper. The dry toner is transferred to the paper in a transfer subsystem and permanently fixed to the paper with heat and pressure in a fusing system. The fusing system is typically composed of a heated fuser roller, a heated or unheated pressure roller and an oiler (wick roller) for applying a release fluid (fuser oil). Alternatively a fuser belt system may be used. Both systems require the use of a wick roller to apply oil to the fuser surface. The fuser oil is typically uniformly applied across the fuser surface where toner will come in contact with the fuser surface. Since copier/duplicator machines run various paper widths and image directions, the fuser oil is required to be applied to the fuser surface over at least a length as long as the widest paper to be fused. When large quantities of narrower paper are run this can cause excessive fuser oil problems on the outer portions of fuser surface. This problem is particularly acute in copier/duplicator machines where a range of wide and narrow paper is used with predominately the narrower paper being used. When running the narrower paper, oil is still applied to the ends of the fuser surface outside the paper edges. This oil will continue to accumulate until it may run off the fuser surface, evaporate or be taken away with the wider sheets when they are run. The excess oil delivered to the fuser surface can cause various problems. For instance oil running off the fuser surface will contaminate the copier/duplicator machine and possibly stain a customer's floor or the like. Oil evaporation results in oil vapor which may come in contact with the corona charger thereby reducing the life of the corona charger by depositing silicone onto the corona charger wires thus reducing the charger uniformity. Excess oil taken away on the copy can cause oil staining on colored paper, reduce the ability to write on copies with a ball point pen and possibly result in the transfer of excess oil to the photoconductor film which will cause image generation defects and the excess oil may reduce paper drive roller friction thus effecting the paper handling performance. Clearly the presence of the excessive oil on the outer ends of the fuser surface is very undesirable.

Previous solutions to this problem have been to supply the customer or user of the copier/duplicator machine with custom size wick rollers for specific paper sizes. This is not easily done with copier/duplicator machines where multiple paper widths can be loaded into the same machine for selection by the user. The use of a plurality of wick rollers in such machines is not feasible.

Accordingly, a continuing search has been directed to the development of methods for supplying fuser oil to the fuser surface in the required quantities while avoiding the build up of fuser oil on the outer ends on the fuser surface when large numbers of narrower copies are run.

SUMMARY OF THE INVENTION

It has now been found that the accumulation of oil on the outer ends of the fuser surface can be avoided and more uniform fuser oil distribution on a fuser surface is achieved by positioning a fuser oil redistribution roller in interactive contact with at least one of the fuser surface and a heater roller in interactive contact with the fuser surface, the redistribution roller consisting essentially of a porous material body covered along its length in contact with the fuser surface or at least one heater roller with a compliant oil transfer material.

The invention further comprises a fuser system having more uniform fuser oil distribution comprising: a fuser surface; a pressure roller positioned to engage paper bearing a toner image between the fuser surface and the pressure roller; a wick roller positioned to engage the fuser surface and apply a selected quantity; of fuser oil to the fuser surface ahead of engagement of the paper by the fuser surface; and, a fuser oil redistribution roller positioned to interactively engage at least one of the fuser surface after the fuser surface has engaged the paper and at least one heater roller in interactive contact with the fuser surface.

DESCRIPTION OF PREFERRED EMBODIMENTS

In the description of the Figures the same numbers will be used throughout to refer to the same or similar components.

Figure 1:
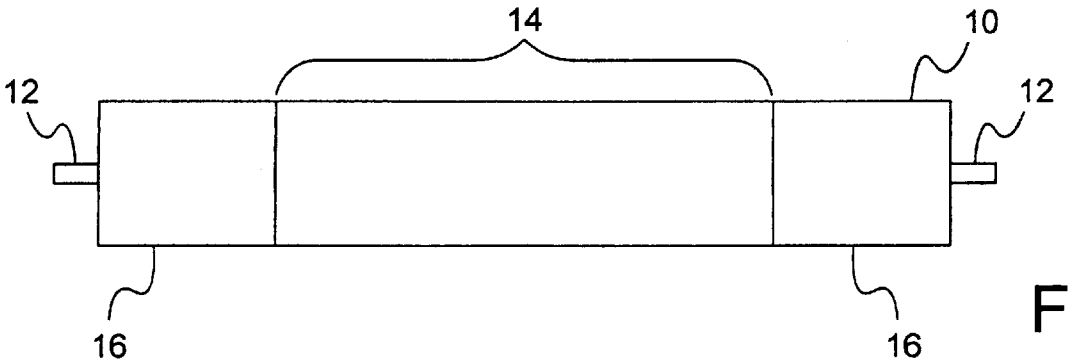
FIG. 1 (PRIOR ART)
FIG. 1 is a schematic diagram of a conventional fuser roller.

In FIG. 1, a conventional fuser roller 10 is shown. Such fuser rollers are considered to be well known to those skilled in the art as discussed for instance in U.S. Pat. No. 5,871,878 issued Feb. 16, 1999 to Chatterjee et al. This patent is hereby incorporated in its entirety by reference. Such fuser rollers typically comprise a body which may be of any suitable material such as aluminum and includes a coating of filled silicone rubber or other suitable elastomer on its outer surface as known to those skilled in the art. Further the fuser roller may be covered with two or more layers which have different heat conductivities or other properties. The fuser roller may be constructed of a variety of materials and in a variety of ways as well known to those skilled in the art.

The fuser roller may typically include mounts 12 which may be of substantially any suitable configuration for supporting fuser roller 10 in position. Fuser roller 10 is shown having a middle section 14 which is of a width corresponding to the width of a most commonly run paper width. The additional length of fuser roller 10 shown by end portions 16 is necessary for occasional wider copies which may be run. When wider copies are run frequently fuser oil which is applied substantially uniformly across fuser roller 10 is used at a substantially uniform rate. However, when a large percentage of the copies run are of the narrower width the fuser oil applied to fuser roller 10 tends to accumulate on end portions 16. As discussed previously this can lead to a number of problems.

Figure 2:
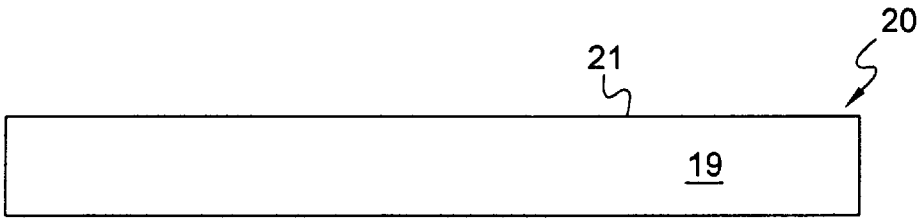
FIG. 2 (PRIOR ART)
FIG. 2 is a schematic diagram of a conventional wick roller.

In FIG. 2, a typical oiler or wick roller 20 is shown. Wick roller 20 comprises a body 19 which is formed of any suitable ceramic or non-ceramic porous material. Wick roller 20 is covered with an oil transport surface 21 which may be of any suitable material. One such suitable material is an arimid fiber material supplied under the trademark NOMAX by Dupont de Nemours and Company, 1007 Market Street, Wilmington, Del. This material is a compliant felt material which is suitable for use at the temperatures at the fuser roller surface to transfer oil from the wick roller 20. It will be noted that wick roller 20 is of substantially the same length as fuser roller 10. A tube (not shown) is typically positioned through the length of fuser roller 20 and fuser oil is discharged into the inside of body 19 and diffuses through body 19 and passes through oil transport surface 21 to wick roller 10. Typically the oil is supplied in a quantity of approximately one to about 20, and more typically from about 1 to about 3 microliters per sheet of copy.

Figure 3:
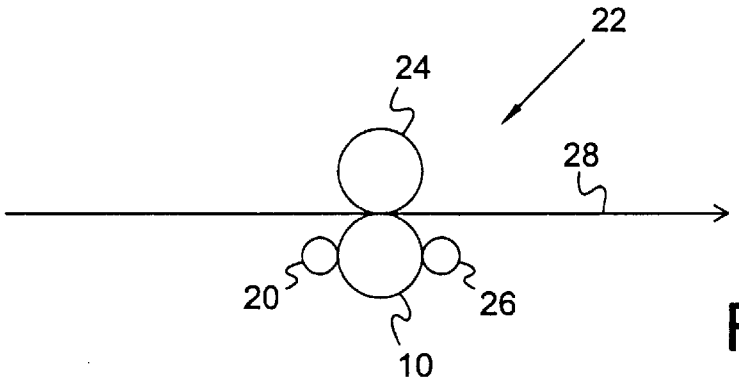
FIG. 3 is a schematic diagram of a fuser roller system according to the present invention.

In FIG. 3, an embodiment of the present invention is shown. A pressure roller 24 and fuser roller 10 are shown in interactive engagement to apply heat and pressure to paper which passes between fuser roller 10 and pressure roller 24 in a path generally shown by the arrow 28. Fuser roller system 22 includes not only fuser roller 10 and pressure roller 24 but also includes wick roller 20 and a fuser roller oil redistribution roller 26. Redistribution roller 26 comprises a porous body which may be of any suitable porous ceramic or non-ceramic material such as the material used for body 19. Redistribution roller 26 also includes a compliant cover (not shown) which is not limited to but may be the same material used with wick roller 20. Unlike wick roller 20 redistribution roller 26 does not include an oil supply system. Alternatively redistribution roller 26 is positioned in active engagement with fuser roller 10 at a contact point after the contact of fuser roller 10 with the paper. At this point fuser oil which may have accumulated on end portions 16 of fuser roller 10 is absorbed into the surface of redistribution roller 26. Since greater quantities of fuser oil are absorbed into the end portions of fuser roller 26 the oil tends to migrate through the porous body of redistribution roller 26 toward the inner portions of the roller which absorb less or no oil from the middle portion of the fuser roller. At this point the oil is free to move back to the surface and be reapplied to the central portion of fuser roller 10. Since the ends of wick roller 20 and redistribution roller 26 are sealingly capped no oil is able to move outside the ends of either wick roller 20 or redistribution roller 26. The net result is that redistribution roller 26 absorbs excess fuser oil from the end portions of fuser roller 10 into its porous structure with the oil then moving from an area of high oil concentration (the end portions) to an area of low oil concentration which is in the area of redistribution roller 26 corresponding to the middle section 14 of fuser roller 10 from which it is redistributed to the middle section 14.

Figure 4:
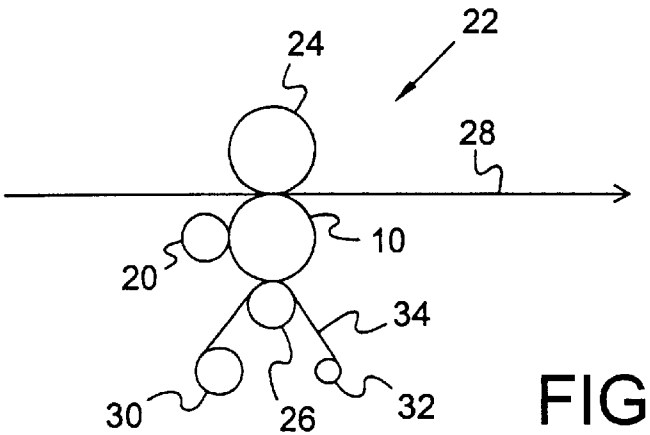
FIG. 4 is a schematic diagram of an alternate embodiment of the fuser roller system shown in FIG. 3.

In FIG. 4, a further embodiment of the embodiment in FIG. 3 is shown. In this embodiment, a web 34 is positioned between redistribution roller 26 and fuser roller 10. A web supply roller 30 is shown and a web collection roller 32 is shown. Typically the web when used in this fashion results in an accumulation of oil from the high oil areas of fuser roller 10 at the web thereby facilitating absorption of the oil into redistribution roller 26. The oil once absorbed migrates to areas of lower concentration and back to the center portion of fuser roller 10 as discussed above. Web 34 is of a conventional design and functions not only to facilitate the collection and redistribution of oil but also functions to clean fuser roller 10. Typically such webs which are well known to those skilled in the art may be moved approximately 0.08 inches per each 275 copies. Variations in the amount of movement required will depend upon the amount of contamination found on fuser roller 10 and the like. Such variations are considered to be well known to those skilled in the art.

Figure 5:
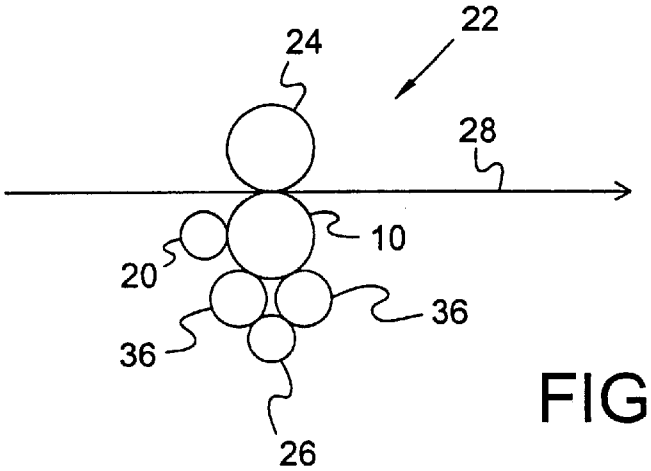
FIG. 5 is a schematic diagram of an alternate embodiment of the system of the present invention.

In FIG. 5, an alternate embodiment of the present invention is shown. In the embodiment shown in FIGS. 3 and 4, either or both of the pressure roller 24 or fuser roller 10 may be heated. Either roller may be heated by an internal heating element radiant heat or any other suitable means known to those skilled in the art. In FIG. 5 two heater rollers 36 are used to heat fuser roller 10. In this embodiment redistribution roller 26 is positioned to contact heater rollers 36. Oil is removed from fuser roller 10 by heater rollers 36 and is removed from heater rollers 36 by redistribution roller 26 and redistributed back onto the central portions of heater rollers 36 and then to the central portion of fuser roller 10 as discussed previously.

Figure 6:
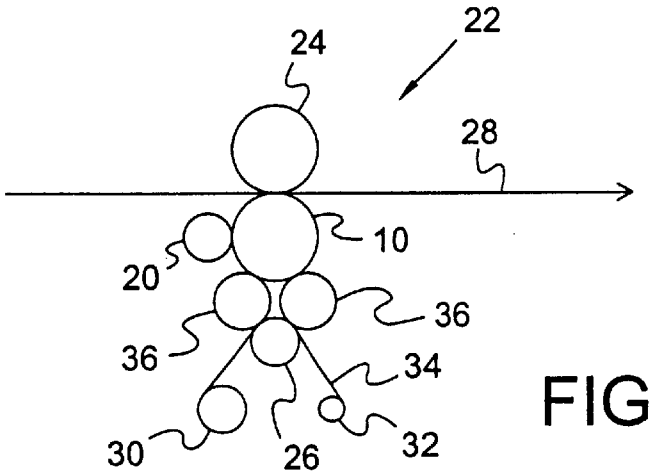
FIG. 6 is a schematic diagram of an alternate embodiment of the system shown in FIG. 5.

In FIG. 6, a variation of the embodiment discussed in conjunction with FIG. 5 is shown. In this embodiment, a web is used as discussed in conjunction with FIG. 4. The oil is removed from the outside of heater rollers 36 by a damming action at the web thereby enabling its absorption by redistribution roller 26 and redistribution to a middle portion of heater rollers 36 and then back to a middle portion of fuser roller 10.

A variety of pressure rollers, fuser rollers, heater rollers, wick rollers and redistribution rollers may be used in the embodiments of the present invention provided that the redistribution roller contacts fuser roller 10 after contact of fuser roller 10 with the paper in the path shown by arrow 28 or heater rollers 36. It is desirable that a fresh charge of oil be supplied by wick roller 20 in each instance to fuser roller 10 prior to contacting the paper in paper path 28 with the surface of fuser roller 10.

Figure 7:
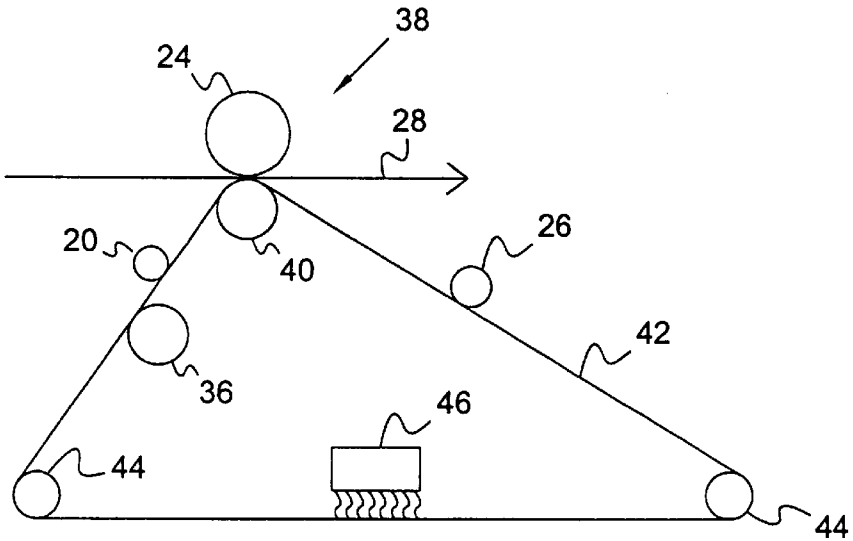
FIG. 7 is a schematic diagram of a fuser belt system embodying the system of the present invention.

In FIG. 7, an alternate system for fusing the toner to the paper is shown. In this embodiment, the fuser surface provided by the fuser roller in FIGS. 3 through 6 is supplied by a fuser belt system 38. In fuser belt system 38, a backup roller 40 is positioned opposite pressure roller 24 and either or both of these rollers may be heated or a fuser belt 42 may be the supply of the heat. Fuser belt 42 may be of any suitable material such as stainless steel, polyester or the like. A fuser belt system is described in U.S. Pat. No. 6,096,427 issued Aug. 1, 2000 to Chen et al. This patent is hereby incorporated in its entirety by reference. In such systems the fuser belt is supported by illustrative rollers 44 for rotation to engage paper passed along a paper path 28. Wick roller 20 supplies fuser oil to the fuser surface of fuser belt 42 as shown. A heater 36 is shown ahead of wick roller 20 to supply heat. A redistribution roller 26 is shown to remove excess oil from the outer ends of fuser belt 42. As shown in FIG. 7 a radiant heater 46 of any suitable type may be used to supply heat to fuser belt 42. In such embodiments the redistribution roller functions in the same way as discussed above to absorb oil selectively from the end portions of the fuser surfaces of fuser belt 42 and redistribute the oil to the middle portion of the fuser surface of fuser belt 42.

Figure 8:
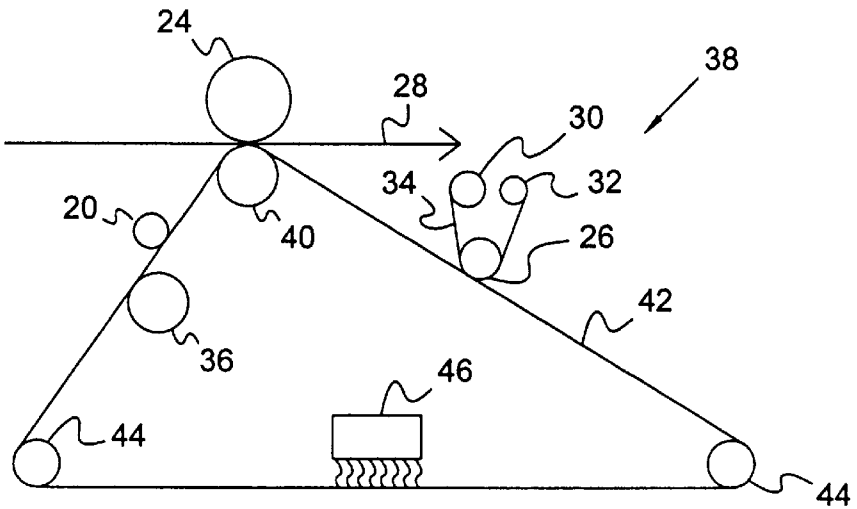
FIG. 8 is an alternate embodiment of the embodiment shown in FIG. 7.

In FIG. 8, a variation of the embodiment shown in FIG. 7 is shown. In this embodiment, a web 34 is used to clean the surfaces of fuser belt 42. A supply roller 30 and a web collection roller 32 are shown. The use of such webs for cleaning is well known. The web functions both to clean fuser surfaces on fuser belt 42 and to facilitate the absorption of fuser oil into redistribution roller 26.

Figure 9:
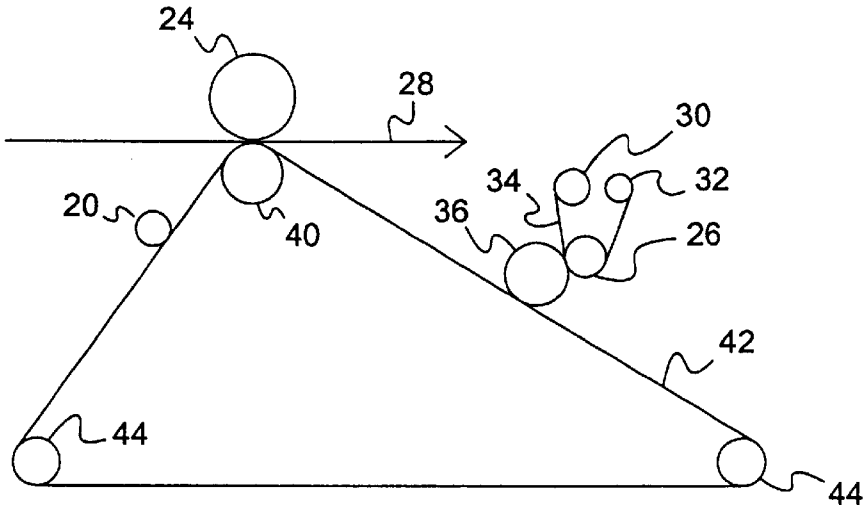
FIG. 9 is an alternate embodiment of a fuser roller according to the present invention; and, FIG. 10 is an embodiment of a preferred configuration of a wick roller useful in conjunction with both the fuser roller and the fuser belt embodiments.

In FIG. 9, an alternate embodiment is shown where a cleaning web 34 is shown in conjunction with a heating roller 36. The web functions as discussed previously to facilitate the transfer of oil from end portions of heating roller 36 to redistribution roller 26.

Figure 10:
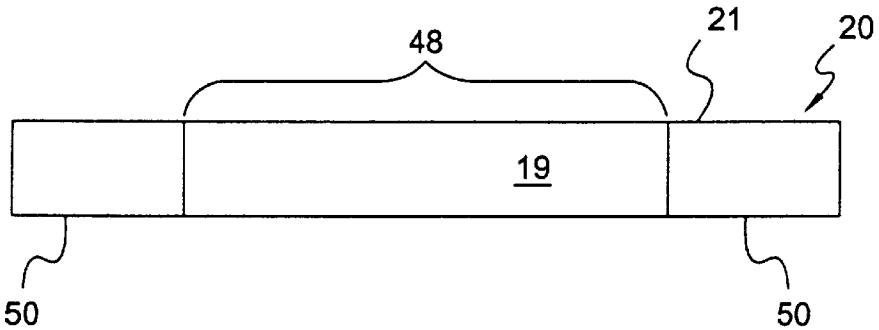

In a further variation of the present invention, it is desirable that the wick roller be configured as shown in FIG. 10. Such a wick roller is more fully disclosed in U.S. Patent Application entitled "METHOD AND IMPROVED WICK ROLLER FOR CONTROLLING THE DISTRIBUTION OF FUSER OIL ON A FUSER SURFACE" filed of even date herewith by Susan C. Baruch et al. In the roller shown in FIG. 1, an oil impervious material is placed over end portions 50 of wick roller 20. Wick roller cover 21 is then positioned over both the oil impervious material and an open middle section 48 of wick roller 20. Middle section 48 corresponds to the width of the most commonly run paper. Small openings are positioned in the oil impervious covers on ends 50 to limit the amount of oil passing to end portions 16 of fuser roller 10. The use of the roller of FIG. 10 may not be necessary in the instances where a relatively wide range of paper widths are run on a relatively consistent basis. Alternatively, it may be desirable to use both the wick roller of the configuration shown in FIG. 10 in conjunction with the fuser oil redistribution roller of the present invention to adequately control the oil accumulation on the end portions 16 of fuser roller 10 when predominantly numerous copies are run.

As discussed previously, redistribution roller 26 is porous and covered with an oil permeable cover so that it readily absorbs oil from areas of high concentration on fuser roller 10. The absorbed oil then is free to migrate through the pores in the body of redistribution roller 26 to areas of lower oil concentration. These areas are the middle portions of redistribution roller 26. Since the fuser oil cannot escape from the ends of fuser roller 26 it moves toward the middle areas of fuser roller 26 where it eventually is returned to the surface of fuser roller 10. This results in a continuous net transfer of fuser oil from the outside portions of fuser surfaces on either the belt fuser or the fuser roller to the middle portions where the oil is regularly removed by the paper copies passed through the copier/duplicator machine. The use of the web tends to result in damming the oil to a certain extent to retain it in residence for a longer period to achieve absorption into redistribution roller 26 along with cleaning the surfaces contacted by the web and to a certain extent facilitating the transfer of the oil by virtue of the presence of the web.

In combination, the redistribution roller 26 and the web 34 result in an effective absorption of oil from outer portions of the fuser roller and a transfer of the oil via the redistribution roller into the middle portions of the fuser roller. This is a very desirable result and eliminates the problems resulting from the accumulation of oil on the outer ends of the fuser roller.

Having thus described the invention by reference to certain of its preferred embodiments, it is respectively pointed out that the embodiments described are illustrative rather than limiting in nature and that many variations and modifications are possible within the scope of the present invention. Many such variations and modifications may appear obvious and desirable to those skilled in the art based upon a review of the fore going description of preferred embodiments.

Having thus described the invention, we hereby claim:

1. A method for providing more uniform fuser oil distribution of fuser oil supplied by contact between a wick roller and a fuser roller on a fuser surface by positioning a fuser oil redistribution roller in interactive contact with at least one of the fuser surface between the fuser surface after contact with paper and before the fuser surface contact with the wick roller and a heater roller in interactive contact with the fuser surface, the redistribution roller consisting essentially of a porous material body covered along its length in contact with the fuser surface or the at least one heater roller with a compliant oil transfer material.

2. The method of claim 1 wherein the fuser oil is a silicone oil having a viscosity between about 100 and about 100,000 centistokes at 70° F.

3. The method of claim 1 wherein an absorbent web cleaner is positioned between the redistribution roller and the fuser surface or at least one heater roller to clean the fuser surface or at least one heater roller and further redistribute the fuser oil on the fuser surface.

4. The method of claim 1 wherein the fuser surface comprises a fuser roller.

5. The method of claim 1 wherein the fuser surface comprises a fuser belt.

6. method for more uniformly distributing a fuser oil on a fuser surface, the fuser surface interacting with a pressure roller to contact and fix a toner image to a paper by;

a) positioning a wick roller in interactive contact with the fuser surface ahead of the fuser surface contact with the paper to deposit a selected quantity of fuser oil on the fuser surface; and b) positioning a fuser oil redistribution roller in interactive contact with at least one of the fuser surface after the fuser surface contact with the paper and at least one heater roller in interactive contact with the fuser roller to redistribute the fuser oil on the fuser surface.

7. The method of claim 6 wherein a web cleaner is positioned between the redistribution roller and the at least one of the fuser surface and the at least one heater roller.

8. The method of claim 6 wherein the fuser oil is a silicone oil having a viscosity from about 100 to about 100,000 centistokes at 70° F.

9. The method of claim 6 wherein the fuser surface comprises a fuser roller.

10. The method of claim 6 wherein the fuser surface comprises a fuser belt.

11. The method of claim 6 wherein the wick roller is configured to deposit less fuser oil on outer end portions of the fuser surface than in a middle portion of the fuser surface.

12. A fuser system having more uniform fuser oil distribution comprising;

a) a fuser surface;

b) a pressure roller positioned to engage paper bearing a toner image between the fuser surface and the pressure roller;

c) a wick roller positioned to engage the fuser surface and apply a selected quantity of fuser oil to the fuser surface ahead of engagement of the paper by the fuser surface; and, d) a fuser oil redistribution roller positioned to interactively engage at least one of the fuser surface after the fuser surface has engaged the paper and at least one heater roller in interactive contact with the fuser surface.

13. The system of claim 12 wherein the fuser oil redistribution roller consists essentially of a porous material body covered along its length in contact with the fuser roller with a compliant oil transfer material.

14. The system of claim 12 wherein the system further comprises a web cleaner positioned between the fuser surface and the redistribution roller to clean the fuser surface and redistribute the fuser oil on the fuser surface.

15. The system of claim 12 wherein the fuser surface comprises a fuser roller.

16. The system of claim 12 wherein the fuser surface comprises a fuser belt.

17. The system of claim 12 wherein a web cleaner is positioned between the fuser oil distribution roller and at least one of the fuser surface and the at least one heater roller.

18. The system of claim 12 wherein the wick roller is configured to deposit less fuser oil on outer ends of the fuser surface than on a middle portion of the fuser surface.

19. The system of claim 12 wherein the fuser surface is a fuser belt and a backup pressure roller is positioned against the pressure roller.

20. The system of claim 12 wherein two heater rollers are included.

* * * * *